US010316436B2

(12) United States Patent
Xue et al.

(10) Patent No.: US 10,316,436 B2
(45) **Date of Patent: *Jun. 11, 2019**

(54) METHOD AND DEVICE OF DYNAMICALLY CONFIGURING LINEAR DENSITY AND BLENDING RATIO OF YARN BY THREE-INGREDIENT ASYNCHRONOUS/SYNCHRONOUS DRAFTED

(71) Applicant: JIANGNAN UNIVERSITY, Wuxi (CN)

(72) Inventors: Yuan Xue, Wuxi (CN); Weidong Gao, Wuxi (CN); Mingrui Guo, Wuxi (CN); Jian Zhou, Wuxi (CN); Ruihua Yang, Wuxi (CN); Hongbo Wang, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 296 days.

This patent is subject to a terminal disclaimer.

(21) Appl. No.: 15/308,365

(22) PCT Filed: Jul. 28, 2015

(86) PCT No.: PCT/CN2015/085269

§ 371 (c)(1),
(2) Date: Nov. 2, 2016

(87) PCT Pub. No.: WO2016/155166

PCT Pub. Date: Oct. 6, 2016

(65) Prior Publication Data

US 2017/0067188 A1 Mar. 9, 2017

Related U.S. Application Data

(63) Continuation of application No. PCT/CN2015/085269, filed on Jul. 28, 2015.

(30) Foreign Application Priority Data

Mar. 27, 2015 (CN) ..... 2015 1 0140466
Mar. 27, 2015 (CN) ..... 2015 1 0140910

(51) Int. Cl.
*D02G 3/04* (2006.01)
*D01H 5/22* (2006.01)
*D01H 5/36* (2006.01)

(52) U.S. Cl.
CPC ..... *D02G 3/04* (2013.01); *D01H 5/22* (2013.01); *D01H 5/36* (2013.01)

(58) Field of Classification Search
CPC .. D01H 5/22; D01H 5/32; D01H 5/36; D01H 5/74–5/82
See application file for complete search history.

(56) References Cited

U.S. PATENT DOCUMENTS 46,896 A * 3/1865 Goodspeed ..... B65H 27/00 492/39
2,198,279 A * 4/1940 Weinberger ..... D01H 5/74 19/258

(Continued)

FOREIGN PATENT DOCUMENTS

CN 1336453 A 2/2002
CN 102031600 A 4/2011

(Continued)

*Primary Examiner* — Shaun R Hurley
(74) *Attorney, Agent, or Firm* — Gokalp Bayramoglu

(57) ABSTRACT

The invention discloses a method of dynamically configuring linear density and blending ratio of yarn by three-ingredient asynchronous/synchronous drafted, comprising: a drafting and twisting system, which includes a first stage drafting unit, a successive second stage drafting unit and an integrating and twisting unit. The first stage drafting unit includes a combination of back rollers and a middle roller. The second stage drafting unit includes a front roller and the (Continued)

middle roller. Blending proportion and linear densities of three ingredients are dynamically adjusted by the first stage asynchronous drafting mechanism, and reference linear density is adjusted by the second stage synchronous drafting mechanism. The invention can not only accurately control linear density change, but also accurately control a color change of the yarn. Further, the rotation rate of the middle roller is constant, ensuring a reproducibility of the patterns and colors of the yarn with a changing linear density.

15 Claims, 3 Drawing Sheets

(56) References Cited

U.S. PATENT DOCUMENTS 2,991,514 A * 7/1961 Cotchett ..... D01H 5/76 19/295
3,020,697 A * 2/1962 Sherman ..... D02G 3/346 19/288
3,599,305 A * 8/1971 Aurich ..... H01H 36/00 100/917
5,161,284 A * 11/1992 Leifeld ..... D01H 1/22 19/243
5,343,598 A * 9/1994 Hauner ..... D01G 15/46 19/150
5,774,943 A * 7/1998 Clapp ..... D01H 5/46 19/240
5,796,220 A * 8/1998 Clapp ..... D01H 5/42 19/157
6,021,548 A * 2/2000 Temburg ..... D01H 13/04 19/150
6,182,333 B1 * 2/2001 Lauhus ..... D01H 5/80 19/236
6,289,599 B1 * 9/2001 Leifeld ..... B65H 63/062 19/23
2017/0051439 A1 * 2/2017 Gao ..... D01H 5/36
2017/0073849 A1 * 3/2017 Gao ..... D01H 5/36
2017/0268134 A1 * 9/2017 Xue ..... D01H 5/36

FOREIGN PATENT DOCUMENTS

CN 102995174 A 3/2013
CN 203795057 U 8/2014
CN 104711720 A 6/2015
CN 104762713 A 7/2015
CN 204530071 U 8/2015
WO WO2015033811 A1 3/2015

* cited by examiner

METHOD AND DEVICE OF DYNAMICALLY CONFIGURING LINEAR DENSITY AND BLENDING RATIO OF YARN BY THREE-INGREDIENT ASYNCHRONOUS/SYNCHRONOUS DRAFTED

CROSS REFERENCE TO RELATED APPLICATIONS

This application is a national phase entry application of International Application No. PCT/CN2015/085269, filed on Jul. 28, 2015, which is based upon and claims priority to NO. CN201510140910.4, filed on Mar. 27, 2015, claims another priority to NO. CN201510140466.6, filed on Mar. 27, 2015, the entire contents of which are incorporated herein by reference.

TECHNICAL FIELD

The invention relates to a ring spinning filed of a textile industry, and particularly relates to a method and device of dynamically configuring a linear density and a blending ratio of a yarn by three-ingredient asynchronous/synchronous drafted.

BACKGROUND

Yarn is a long and thin fiber assembly formed by orienting in parallel and twisting of fiber. The characteristic parameters generally include fineness (linear density), twist, blending ratio (color blending ratio), etc. The characteristic parameters are important features which should be controlled during a forming process.

The yarn can be divided into four categories:

(1) yarn with a constant linear density and a variable blending ratio, such as a color yarn of constant liner density, with a gradient or segmented color;

(2) yarn with a constant blending ratio and variable linear density, such as a slub yarn, a dotted yarn, etc.;

(3) yarn with a variable linear density and blending ratio, such as segmented a color slub yarn, a segmented color dotted yarn, etc.;

(4) blended yarn or mixed color yarn mixed at any rate, with a constant linear density and blending ratio.

The development of yarn processing technology mainly relates to the problems of special yarns. The existing spinning technology and the patent applications fail to guide the spinning production of the above four types of yarns, challenging the existing spinning theories. Specifically, it is analyzed as follows:

(1) yarn with a constant linear density and a variable blending ratio (color blending ratio)

The yarn with a constant linear density and a variable blending ratio (color blending ratio) can be assumed as a color yarn of constant liner density, with a gradient or segmented color. No existing patent application is related to this type of yarn.

(2) yarn with a constant blending ratio and variable linear density

The yarn with a constant blending ratio and variable linear density, can be such as a slub yarn, a dotted yarn, etc. The existing method of manufacturing the ring spun yarn with a variable linear density comprises feeding one roving yarn each to the middle roller and back roller, and discontinuously spinning to manufacture the yarns with variable linear density by uneven feeding from the back roller. For example, a patent entitled "a discontinuous spinning process and yarns thereof" (ZL01126398.9), comprising: feeding an auxiliary fiber strand B from the back roller; unevenly drafting it via the middle roller and back roller; integrating with another main fiber strand A fed from the middle roller, and entering into the drafting area; drafting them by the front roller and middle roller, and outputting from the jaw of the front roller; entering into the twisting area to be twisted and form yarns. Because the auxiliary fiber strand is fed from the back roller intermittently and integrates with the main fiber strand, under the influence of the front area main drafting ratio, the main fiber strand is evenly attenuated to a certain linear density, and the auxiliary fiber strand is attached to the main fiber strand to form a discontinuous and uneven linear density distribution. By controlling the fluctuation quantity of the uneven feeding from the back roller, different effects such as a dotted yarn, a slub yarn, etc. are obtained finally on the yarn. The deficiencies of this method are that the main and auxiliary fiber strands cannot be exchanged and a range of slub thickness is limited.

(3) yarn with a variable linear density and blending ratio

No existing patent application relates to this type of yarn.

(4) blended yarn or mixed color yarn mixed at any rate, with a constant linear density and blending ratio The blended yarn or mixed color yarn mixed at any rate, with a constant linear density and blending ratio, are disclosed. The current method comprises blending two or more than two different ingredients to obtain a roving yarn at a certain blending ratio, by fore-spinning process, then spinning the roving yarn to form a spun yarn by spinning process to obtain a yarn with a constant linear density and a blending ratio. Usually spinning processes can only achieve several conventional proportions, such as 50:50, 65:35, 60:40. The deficiencies are that they cannot be blended at any rate and two or more than two fibers cannot be blended at any rate in a single step.

SUMMARY OF THE INVENTION

To solve the above problems, the objective of this invention is to disclose a process of providing three-ingredient asynchronous/synchronous two-stage drafting fiber strands, and then integrating and twisting to form a yarn. The linear density and blending ratio of a ring spun yarn can be adjusted arbitrarily. The invention can adjust the linear density and blending ratio of the yarn at the same time to produce the above four types of yarns, overcoming the limitation of being unable to adjust characteristic parameters of a yarn on line.

To achieve the above objectives, the invention discloses a method of dynamically configuring linear density and blending ratio of yarn by three-ingredient asynchronous drafting, comprising:

1) An actuating mechanism mainly includes a three-ingredient asynchronous/synchronous two-stage drafting mechanism, a twisting mechanism and a winding mechanism. The three-ingredient asynchronous/synchronous two-stage drafting mechanism includes a first stage asynchronous drafting unit and a successive second stage synchronous drafting unit;

2) The first stage asynchronous drafting unit includes a combination of back rollers and a middle roller. The combination of back rollers has three rotational degrees of freedom and includes a first back roller, a second back roller, a third back roller, which are set abreast on a same back roller shaft. A first back roller, a second back roller, a third back roller move at the speeds $V_{h1}$, $V_{h2}$, and $V_{h3}$ respectively. The middle roller rotates at the speed $V_z$. The second stage synchronous drafting unit includes a front roller and the middle roller. The front roller rotates at the surface linear speed $V_q$.

Assuming the linear densities of a first roving yarn ingredient, a second roving yarn ingredient, a third roving yarn ingredient drafted by a first back roller, a second back roller, a third back roller are respectively $\rho_1$, $\rho_2$, and $\rho_3$, the linear density of the yarn Y drafted and twisted by the front roller is $\rho_y$.

$$\rho_y = \frac{1}{V_q}(V_{h1} * \rho_1 + V_{h2} * \rho_2 + V_{h3} * \rho_3) \tag{1}$$

The blending ratios of the first roving yarn ingredient, the second roving yarn ingredient, and the third roving yarn ingredient are respectively $k_1$, $k_2$, and $k_3$.

$$k_1 = \frac{\rho_1''}{\rho_1'' + \rho_2'' + \rho_3''} = \frac{\rho_1'}{\rho_1' + \rho_2' + \rho_3'} = \frac{\rho_1 * V_{h1}}{\rho_1 * V_{h1} + \rho_2 * V_{h2} + \rho_3 * V_{h3}}$$

$$k_2 = \frac{\rho_2''}{\rho_1'' + \rho_2'' + \rho_3''} = \frac{\rho_2'}{\rho_1' + \rho_2' + \rho_3'} = \frac{\rho_2 * V_{h2}}{\rho_1 * V_{h1} + \rho_2 * V_{h2} + \rho_3 * V_{h3}}$$

$$k_3 = \frac{\rho_3''}{\rho_1'' + \rho_2'' + \rho_3''} = \frac{\rho_3'}{\rho_1' + \rho_2' + \rho_3'} = \frac{\rho_3 * V_{h3}}{\rho_1 * V_{h1} + \rho_2 * V_{h2} + \rho_3 * V_{h3}}$$

3) Keeping the ratio of linear speeds of the front roller and the middle roller $V_q/V_z$ constant, the speeds of the front roller and the middle roller depend on reference linear density of the yarn;

4) The linear density of yarn Y or/and blending ratio can be dynamically adjusted on line, by adjusting the rotation rates of the first back roller, the second back roller.

Further, according to the changes of the blending ratio K of the yarn Y with time t, and the changes of the linear density $\rho_y$ of the yarn Y with the time t, the changes of the surface linear speeds of a first back roller, a second back roller, a third back roller are derived. The blending ratios of the first roving yarn ingredient, the second roving yarn ingredient, the third roving yarn ingredient are set respectively as $k_1$, $k_2$, and $k_3$. The ratios of blending ratios of the yarn Y are respectively $K_1$, and $K_2$.

$$K_1 = \frac{k_1}{k_2} = \frac{\rho_1 V_{h1}}{\rho_2 V_{h3}}$$

$$K_2 = \frac{k_1}{k_3} = \frac{\rho_1 V_{h1}}{\rho_3 V_{h3}}$$

Linear density of yarn Y is $$\rho_y = \frac{V_{h1} * \rho_1 + V_{h2} * \rho_2 + V_{h3} * \rho_3}{V_q}$$

Then a surface linear speed of the back roller 1:

$$V_{h1} = \frac{\rho_y V_q}{\rho_1\left(1 + \frac{1}{K_1} + \frac{1}{K_2}\right)}$$

a surface linear speed of the back roller 2:

$$V_{h2} = \frac{\rho_y V_q}{\rho_2\left(1 + K_1 + \frac{K_1}{K_2}\right)}$$

a surface linear speed of the back roller 3:

$$V_{h3} = \frac{\rho_y V_q}{\rho_3\left(1 + K_2 + \frac{K_2}{K_1}\right)}$$

wherein $\rho_1$, $\rho_2$, and $\rho_3$ are constants, and $K_i$ and $\rho_y$ are functions changing with time t.

Further, let $\rho_1=\rho_2=\rho_3=\rho$, then:

1) change the speed of any one of the first back roller, the second back roller, and the third back roller, and keep the speeds of the other two backer rollers unchanged. The yarn ingredient and the linear density thereof of the yarn Y drafted by this back roller change accordingly. The linear density $\rho'_y$ of the yarn Y is adjusted as:

$$\rho'_y = \rho_y + \Delta\rho_y = \frac{\rho}{V_q} * (V_{h1} + V_{h2} + V_{h3} + \Delta V_{h3}) \text{ or}$$

$$\rho'_y = \rho_y + \Delta\rho_y = \frac{\rho}{V_q} * (V_{h1} + V_{h2} + V_{h3} + \Delta V_{h2}) \text{ or}$$

$$\rho'_y = \rho_y + \Delta\rho_y = \frac{\rho}{V_q} * (V_{h1} + V_{h2} + V_{h3} + \Delta V_{h1})$$

wherein $\Delta\rho_y$ is a linear density change of the yarn, $\Delta V_{h1}$, $\Delta V_{h2}$ and $\Delta V_{h3}$ is a speed change of the first back roller, the second back roller, and the third back roller respectively.

2) change the speeds of any two back rollers of the first back roller, the second back roller, and the third back roller, and keep the speeds of the other backer rollers unchanged. The yarn ingredients of the yarn Y drafted by these any two back rollers and the linear densities thereof change accordingly. The linear density $\rho'_y$ of yarn Y is adjusted as:

$$\rho'_y = \rho_y + \Delta\rho_y = \frac{\rho}{V_q} * [V_{h1} + V_{h2} + V_{h3} + (\Delta V_{h1} + \Delta V_{h2})] \text{ or}$$

$$\rho'_y = \rho_y + \Delta\rho_y = \frac{\rho}{V_q} * [V_{h1} + V_{h2} + V_{h3} + (\Delta V_{h2} + \Delta V_{h3})] \text{ or}$$

$$\rho'_y = \rho_y + \Delta\rho_y = \frac{\rho}{V_q} * [V_{h1} + V_{h2} + V_{h3} + (\Delta V_{h1} + \Delta V_{h3})]$$

3) change the speeds of three back rollers of the first back roller, the second back roller, and the third back roller simultaneously. The yarn ingredients of the yarn Y drafted by these any three back rollers and the linear densities thereof change accordingly. The linear density $\rho'_y$ of the yarn Y is adjusted as:

$$\rho'_y = \rho_y + \Delta\rho_y = \frac{\rho}{V_q} * [V_{h1} + V_{h2} + V_{h3} + (\Delta V_{h1} + \Delta V_{h2} + \Delta V_{h3})]$$

further, change the speeds of the first back roller, the second back roller, and the third back roller, and make the speed of any of back rollers equal to zero, while the speeds of the other two backer rollers unequal to zero. The yarn ingredient of the yarn Y drafted by the any one of back rollers is thus discontinuous, while the other two yarn ingredients are continuous. The linear density $\rho'_y$ of yarn Y is adjusted as:

$$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2) \text{ or}$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2) \text{ or}$$

$$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

wherein $T_1$ and $T_2$ are time points, and t is a time variable.

Further, change the speeds of the first back roller, the second back roller, and the third back roller, make the speeds of any two back rollers equal to zero successively, while the speeds of the other one backer rollers unequal to zero. The yarn ingredients of the yarn Y drafted by the any two back rollers are thus discontinuous, while the other yarn ingredients are continuous. The linear density $\rho'_y$ of the yarn Y is adjusted as:

1) When the first back roller is unequal to zero $$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h1} + \Delta V_{h1})] \ (T_2 \le t \le T_3) \text{ or}$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h1} + \Delta V_{h1})] \ (T_2 \le t \le T_3)$$

wherein $T_3$ is time points, and $T_1 \le T_2 \le T_3$

2) When the second back roller is unequal to zero $$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h2} + \Delta V_{h2})] \ (T_2 \le t \le T_3) \text{ or}$$

$$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

$$\rho'_y = \rho_y + \Delta\rho_y = \frac{\rho}{V_q} * [(V_{h2} + \Delta V_{h2})] \ (T_2 \le t \le T_3)$$

3) When the third back roller is unequal to zero $$\rho'_y = \rho_y + \Delta\rho_y =$$

-continued $$\frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h3} + \Delta V_{h3})] \ (T_2 \le t \le T_3) \text{ or}$$

$$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

$$\rho'_y = \rho_y + \Delta\rho_y = \frac{\rho}{V_q} * [(V_{h3} + \Delta V_{h3})] \ (T_2 \le t \le T_3).$$

Further change the speeds of the first back roller, the second back roller, and the third back roller, make the speeds of any two back rollers equal to zero simultaneously, while the speeds of the other one backer rollers unequal to zero. The yarn ingredients of the yarn Y drafted by the any two back rollers are thus discontinuous, while the other one yarn ingredients are continuous. The linear density $\rho'_y$ of the yarn Y is adjusted as:

$$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1})] \ (T_1 \le t \le T_2) \text{ or}$$

$$\rho'_y = \rho_y + \Delta\rho_y = \frac{\rho}{V_q} * [(V_{h2} + \Delta V_{h2})] \ (T_1 \le t \le T_2) \text{ or}$$

$$\rho'_y = \rho_y + \Delta\rho_y = \frac{\rho}{V_q} * [(V_{h3} + \Delta V_{h3})] \ (T_1 \le t \le T_2).$$

Further, change the speeds of the first back roller, the second back roller, and the third back roller, and keep $V_{h1}*\rho_1+V_{h2}*\rho_2+V_{h3}*\rho_3$=constant and $\rho_1=\rho_2=\rho_3=\rho$, then the linear density of the yarn Y is thus fixed while the blending ratios of the ingredients thereof change; the blending ratios of the first yarn ingredient, the second yarn ingredient, and the third yarn ingredient are $k_1$, $k_2$, $k_3$.

$$k_1 = \frac{V_{h1} + \Delta V_{h1}}{V_{h1} + \Delta V_{h1} + V_{h2} + \Delta V_{h2} + V_{h3} + \Delta V_{h3}}$$

$$k_2 = \frac{V_{h2} + \Delta V_{h2}}{V_{h1} + \Delta V_{h1} + V_{h2} + \Delta V_{h2} + V_{h3} + \Delta V_{h3}}$$

$$k_3 = \frac{V_{h3} + \Delta V_{h3}}{V_{h1} + \Delta V_{h1} + V_{h2} + \Delta V_{h2} + V_{h3} + \Delta V_{h3}}$$

Further, according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of a first back roller, a second back roller, a third back roller are $V_{h1i}$, $V_{h2i}$, $V_{h3i}$, wherein $i \in (1, 2, \ldots, n)$. The first roving yarn ingredient, the second roving yarn ingredient, the third roving yarn ingredient ingredient are two-stage drafted and twisted to form segment i of the yarn Y, and the blending ratios $k_{1i}$, $k_{2i}$ and $k_{3i}$ thereof are expressed as below:

$$k_{1i} = \frac{\rho_1 * V_{h1i}}{\rho_1 * V_{h1i} + \rho_2 * V_{h2i} + \rho_3 * V_{h3i}} \quad (2)$$

-continued $$k_{2i} = \frac{\rho_2 * V_{h2i}}{\rho_1 * V_{h1i} + \rho_2 * V_{h2i} + \rho_3 * V_{h3i}} \quad (3)$$

$$k_{3i} = \frac{\rho_3 * V_{h3i}}{\rho_1 * V_{h1i} + \rho_2 * V_{h2i} + \rho_3 * V_{h3i}} \quad (4)$$

the linear density of segment i of yarn Y is:

$$\rho_{yi} = \frac{V_z}{V_q} * \left(\frac{V_{h1i}}{V_z} * \rho_1 + \frac{V_{h2i}}{V_z}\rho_2 + \frac{V_{h3i}}{V_z}\rho_3\right) = \frac{1}{e_q} * \left(\frac{V_{h1i}}{V_z} * \rho_1 + \frac{V_{h2i}}{V_z}\rho_2 + \frac{V_{h3i}}{V_z}\rho_3\right) \quad (5)$$

Wherein $$e_q = \frac{V_q}{V_z}$$

is the two-stage drafting ratio;

(1) Take the segment with the lowest density as a reference segment, whose reference linear density is $\rho_0$. The reference linear speeds of the first back roller, the second back roller, the third back roller for this segment are respectively $V_{h10}$, $V_{h20}$, $V_{h30}$; and the reference blending ratios of the first roving yarn ingredient, the second roving yarn ingredient, the third roving yarn ingredient for this segment are respectively $k_{10}$, $k_{20}$, $k_{30}$, Keep the linear speed of the middle roller constant, and $$V_z = V_{h10} + V_{h20} + V_{h30} \quad (6);$$

(2) also keep two-stage drafting ratio $$e_q = \frac{V_q}{V_z}$$

constant; wherein the reference linear speeds of the first back roller, the second back roller, the third back roller for this segment are respectively $V_{h10}$, $V_{h20}$, $V_{h30}$, which can be predetermined according to the material, reference linear density $\rho_0$ and reference blending ratios $k_{10}$, $k_{20}$, $k_{30}$ of the first roving yarn ingredient, the second roving yarn ingredient, the third roving yarn ingredient.

(3) When the segment i of the yarn Y is drafted and blended, on the premise of known set linear density $\rho_{yi}$ and blending ratios $k_{1i}$, $k_{2i}$, $k_{3i}$, the linear speeds $V_{h1i}$, $V_{h2i}$, $V_{h3i}$, of the first back roller, the second back roller, the third back roller are calculated according to Equations (2)-(6);

(4) Based on the reference linear speeds $V_{h10}$, $V_{h20}$, $V_{h30}$ for the reference segment, increase or decrease the rotation rates of the first back roller, the second back roller, the third back roller to dynamically adjust the linear density or/and blending ratio for the segment i of the yarn Y.

Further, let $\rho_1 = \rho_2 = \rho_3 = \rho$ then Equation (5) can be simplified as $$\rho_{yi} = \frac{\rho}{e_q} * \frac{V_{h1i} + V_{h2i} + V_{h3i}}{V_z}. \quad (7)$$

According to Equations (2)-(4) and (6)-(7), the linear speeds $V_{h1i}$, $V_{h2i}$, $V_{h3i}$ of the first back roller, the second back roller, the third back roller are calculated; based on the reference linear speeds $V_{h10}$, $V_{h20}$, $V_{h30}$, the rotation rates of the first back roller, the second back roller, the third back roller are increased or decreased to reach the preset linear density and blending ratio for the segment i of yarn Y.

Further, at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller, the third back roller have corresponding increments on the basis of the reference linear speed, i.e., when $(V_{h10}+V_{h20}+V_{h30}) \rightarrow (V_{h10}+\Delta V_{h1i}+V_{h20}+\Delta V_{h2i}\ V_{h30}+\Delta V_{h3i})$, the linear density increment of yarn Y is:

$$\Delta\rho_{yi} = \frac{\rho}{e_q * V_z} * (\Delta V_{h1i} + \Delta V_{h2i} + \Delta V_{h3i});$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i} + \Delta V_{h3i}}{V_z} * \frac{\rho}{e_q}. \quad (8)$$

Let $\Delta V_1 = \Delta V_{h1i} + \Delta V_{h2i} + \Delta V_{h3i}$, then Equation (8) is simplified as:

$$\rho_{yi} = \rho_{y0} + \frac{\Delta V_1}{V_z} * \frac{\rho}{e_q}. \quad (9)$$

The linear density of yarn Y can be adjusted by controlling the sum of the linear speed increments $\Delta V_i$ of the first back roller, the second back roller, the third back roller.

Further, let $\rho_1 = \rho_2 = \rho_3 = \rho$ at the moment of switching the segment i−1 to the segment i of the yarn Y, the blending ratios of the yarn Yin Equations (2)-(4) can be simplified as:

$$k_{1i} = \frac{V_{h10} + \Delta V_{h1i}}{V_z + \Delta V_i} \quad (10)$$

$$k_{2i} = \frac{V_{h20} + \Delta V_{h2i}}{V_z + \Delta V_i} \quad (11)$$

$$k_{3i} = \frac{V_{h30} + \Delta V_{h3i}}{V_z + \Delta V_i} \quad (12)$$

The blending ratios of the yarn Y can be adjusted by controlling the linear speed increments of the first back roller, the second back roller, the third back roller;

wherein $$\Delta V_{h1i} = k_{1i} * (V_Z + \Delta V_i) - V_{h10}$$

$$\Delta V_{h2i} = k_{2i} * (V_Z + \Delta V_i) - V_{h20}$$

$$\Delta V_{h3i} = k_{3i} * (V_Z + \Delta V_i) - V_{h30}.$$

Further, let $V_{h1i} * \rho_1 V +_{h2i} * \rho_2 + V_{h3i} * \rho_3 = H$ and H is a constant, then $\Delta V_i$ is constantly equal to zero, and thus the linear density is unchanged when the blending ratios of the yarn Y are adjusted.

Further, let any one to two of $\Delta V_{h1i}$, $\Delta V_{h2i}$, $\Delta V_{h3i}$ be equal to zero, while the remaining ones are not zero, then the one to two roving yarn ingredients can be changed while the other roving yarn ingredients are unchanged. The adjusted blending ratios are:

$$k_{ki} = \frac{V_{hk0} + \Delta V_{hki}}{V_z + \Delta V_i}$$

$$K_{ji} = \frac{V_{hj0}}{V_z + \Delta V_i}$$

wherein k, j∈(1, 2, 3), and k≠j.

Further, let none of $\Delta V_{h1i}$, $\Delta V_{h2i}$, $\Delta V_{h3i}$ be equal to zero, then the proportion of the three roving yarn ingredients in the yarn Y may be changed.

Further, let any one to two of $\Delta V_{h1i}$, $\Delta V_{h2i}$, $\Delta V_{h3i}$ be equal to zero, while the remaining ones are not zero, then the one to two roving yarn ingredients of the segment i of the yarn Y may be discontinuous.

A device for configuring a linear density and a blending ratio of a yarn by three-ingredient asynchronous/synchronous drafted, comprises a control system and an actuating mechanism. The actuating mechanism includes three-ingredient asynchronous/synchronous two-stage drafting mechanism, a twisting mechanism and a winding mechanism. The two-stage drafting mechanism includes a first stage drafting unit and a second stage drafting unit; the first stage drafting unit includes a combination of back rollers and a middle roller. The combination of back rollers has three rotational degrees of freedom and includes a first back roller, a second back roller, a third back roller, which are set abreast on a same back roller shaft. The three back rollers are set adjacently and the driving mechanisms thereof are set on both sides of the three back rollers. The second stage drafting unit includes a front roller and the middle roller.

Further, the control system mainly includes a PLC programmable controller, a servo driver, a servo motor, etc.

Further, any of the three back rollers is fixedly set on the back roller shaft. The other two back rollers are respectively set on the back roller shaft, and independently rotatable with each other.

Further, during the process of drafting, the speed of the middle roller is fixed and no more than the sum of the speeds of the first back roller, the second back roller, the third back roller.

The dotted yarn and slub yarn produced by the method and device of the invention are more even and accurate in color mixing. Further, the rotation rate of the middle roller is constant, ensuring the stable blending effect. The color difference of the yarn from different batches is not obvious. The contrast about technical effects between the invention and the prior art is showed in the following table.

TABLE 1

The contrast about technical effects between the invention and the prior art

| | Dot yarn pattern errors (/100 m) | Slub yarn linear density adjustment error rate | Linear density adjustment error rate | Color-blending evenness |
|---|---|---|---|---|
| prior art | 7-8 | 10-12% | 11-13% | level 2-3 |
| the invention | 1-2 | 1-3% | 1-3% | level 1 |

Therefore, the invention is very effective.

The method of the invention changes the traditional three-ingredient front and back areas synchronous drafting to three-ingredient separate asynchronous drafting (referred to as first stage asynchronous drafting) and three-ingredient integrated synchronous drafting (referred to as second stage synchronous drafting). The blending proportion of the three ingredients and linear density of the yarn are dynamically adjusted by the first stage separate asynchronous drafting, and the reference linear density of the yarn is adjusted by the second stage synchronous drafting. The linear density and the blending ratio of the yarn can be dynamically adjusted online by the three-ingredient separate/integrated asynchronous/synchronous two-stage drafting, combined with the spinning device and process of the twisting, which breaks through the three bottlenecks existing in the slub yarn spinning process of the prior art. The three bottlenecks are: 1. only the linear density can be adjusted while the blending ratio (color change) cannot be adjusted; 2. monotonous pattern of the slub yarn; 3. poor reproducibility of the slub yarn pattern.

Calculations for the Processing Parameters of Three-Ingredient Separate/Integrated Asynchronous/Synchronous Two-Stage Drafting Coaxial Twisting Spinning System According to the drafting theory, the drafting ratio of the first stage drafting is:

$$e_{h1} = \frac{V_z}{V_{h1}} = \frac{\rho_1}{\rho_1'} \tag{1}$$

$$e_{h2} = \frac{V_z}{V_{h2}} = \frac{\rho_2}{\rho_2'} \tag{2}$$

$$e_{h3} = \frac{V_z}{V_{h3}} = \frac{\rho_3}{\rho_2'} \tag{3}$$

The equivalent drafting ratio of the first stage drafting is:

$$\bar{e}_h = \frac{\rho_1 + \rho_2 + \rho_3}{\rho_1' + \rho_2' + \rho_3'} \tag{4}$$

The drafting ratio of the second stage drafting is:

$$e_q = \frac{V_q}{V_z} = \frac{\rho_1'}{\rho_1''} = \frac{\rho_2'}{\rho_2''} = \frac{\rho_3'}{\rho_3''} = \frac{\rho_1' + \rho_2' + \rho_3'}{\rho_1'' + \rho_2'' + \rho_3''} \tag{5}$$

The total equivalent drafting ratio e is:

$$\bar{e} = \frac{\rho_1 + \rho_2 + \rho_3}{\rho_1'' + \rho_2'' + \rho_3''} = \bar{e}_h * e_q \tag{6}$$

The total equivalent drafting ratio $\bar{e}$ is a significant parameter in the spinning process, which is the product of front area drafting ratio and back area drafting ratio.

According to the established spinning model of the invention, the three roving yarns $\rho_1$, $\rho_2$ and $\rho_3$ are asynchronously drafted in the back area and synchronously drafted in the front area and then are integrated and twisted to form a yarn, the blending ratios thereof $k_1$, $k_2$, $k_3$ can be expressed as follows:

$$k_1 = \frac{\rho_1''}{\rho_1''+\rho_2''+\rho_3''} = \frac{\rho_1'}{\rho_1'+\rho_2'+\rho_3'} = \frac{\rho_1 * V_{h1}}{\rho_1 * V_{h1} + \rho_2 * V_{h2} + \rho_3 * V_{h3}} \tag{7}$$

$$k_2 = \frac{\rho_2''}{\rho_1''+\rho_2''+\rho_3''} = \frac{\rho_2'}{\rho_1'+\rho_2'+\rho_3'} = \frac{\rho_2 * V_{h2}}{\rho_1 * V_{h1} + \rho_2 * V_{h2} + \rho_3 * V_{h3}} \tag{8}$$

$$k_3 = \frac{\rho_2''}{\rho_1''+\rho_2''+\rho_3''} = \frac{\rho_2'}{\rho_1'+\rho_2'+\rho_3'} = \frac{\rho_3 * V_{h3}}{\rho_1 * V_{h1} + \rho_2 * V_{h2} + \rho_3 * V_{h3}} \tag{9}$$

As known from the Equations (7), (8), (9) the blending ratios of the three ingredients in the yarn is related to the surface rotation rates $V_{h1}$, $V_{h2}$, $V_{h3}$ of the back rollers and the linear densities $\rho_1$, $\rho_2$, $\rho_3$ of the three roving yarns. Generally, $\rho_1$, $\rho_2$, $\rho_3$ are constant and irrelevant to the time, while $V_{h1}$, $V_{h2}$, $V_{h3}$ are related to the speed of the main shaft. Because the main shaft speed has a bearing on the spinner production, different main shaft speeds are adopted for different materials and product specifications in different enterprises. As such, even though $\rho_1$, $\rho_2$, $\rho_3$ of the roving yarns are constant, the blending ratios determined by Equations (6), (7) change due to the speed change of the main shaft, which results in the changes of $V_{h1}$, $V_{h2}$, $V_{h3}$ rendering the blending ratios uncertain.

In the same way, the three roving yarns are two-stage drafted, integrated and twisted to form a yarn with the following linear density:

$$\rho_y = \frac{\rho_1+\rho_2+\rho_3}{\bar{e}} = \rho_1''+\rho_2''+\rho_3''$$

$$\rho_y = \frac{V_z}{V_q} * \rho_1' + \frac{V_z}{V_q} * \rho_2' + \frac{V_z}{V_q} * \rho_3' = \frac{V_z}{V_q} * \frac{V_{h1}}{V_z} * \rho_1 + \frac{V_2}{V_q} * \frac{V_{h2}}{V_z} \rho_2 + \frac{V_2}{V_q} * \frac{V_{h3}}{V_z} \rho_3$$

and then the linear density of the yarn is:

$$\rho_y = \frac{1}{V_q}(V_{h1} * \rho_1 + V_{h2} * \rho_2 + V_{h3} * \rho_3) \tag{10}$$

As known from Equation (10), the linear density of the yarn is related to the speed $V_{h1}$, $V_{h2}$, $V_{h3}$ of the combination of back rollers and the linear densities $\rho_1$, $\rho_2$, $\rho_3$ of the three roving yarns. Generally, $\rho_1$, $\rho_2$, $\rho_3$ are constant and irrelevant to the time while $V_{h1}$, $V_{h2}$, $V_{h3}$ are related to the main shaft speed set by the spinning machine. Because the main shaft speed has a bearing on the production of the spinning machine, different main shaft speeds would be adopted when spinning the different materials with different product specifications in different enterprises. As such, for the linear density determined by Equation (8), even though $\rho_1$, $\rho_2$, $\rho_3$ of the three roving yarns remain unchanged, $V_{h1}$, $V_{h2}$, $V_{h3}$ would change with the main shaft speed, rendering the linear density uncertain.

From Equation (1):

$$\rho_1' = \frac{V_{h2}}{V_2} * \rho_1$$

From Equation (2):

$$\rho_2' = \frac{V_{h2}}{V_2} * \rho_2$$

From Equation (3):

$$\rho_3' = \frac{V_{h2}}{V_2} * \rho_3$$

$$\therefore \rho_1' + \rho_2' + \rho_3' = \frac{V_{h1} * \rho_1 + V_{h2} * \rho_2 + V_{h3} * \rho_3}{V_z} \tag{11}$$

Equation (9) is substituted in Equation (3) and then solved for the equivalent drafting ratio $\bar{e}_h$:

$$\bar{e}_h = \frac{\rho_1+\rho_2+\rho_3}{V_{h1} * \rho_1 + V_{h2} * \rho_2 + V_{h3} * \rho_3} * V_z \tag{12}$$

Equation (10) is substituted in Equation (5) and then solved for the total equivalent drafting ratio $\bar{e}$:

$$\bar{e} = \frac{\rho_1+\rho_2+\rho_3}{V_{h1} * \rho_1 + V_{h2} * \rho_3 + V_{h3} * \rho_3} * V_z * \frac{V_q}{V_z} \tag{13}$$

$$\bar{e} = \frac{\rho_1+\rho_2+\rho_3}{V_{h1} * \rho_1 + V_{h2} * \rho_2 + V_{h3} * \rho_3} * V_q$$

To negate the changes caused by the different main shaft speeds, the limited condition is provided as follows:

$$\rho_1 = \rho_2 = \rho_3 = \rho \tag{14}$$

Equation (14) is substituted in Equation (9):

$$\rho_1' + \rho_2' + \rho_3' = \rho * \frac{V_{h1} + V_{h2} + V_{h3}}{V_z} \tag{15}$$

Equations (12), (13) are substituted in Equation (10):

$$\bar{e}_h = \frac{V_z}{\frac{V_{h1} + V_{h2} + V_{h3}}{3}} \tag{16}$$

Equations (14) is substituted in Equation (5):

$$\bar{e} = \bar{e}_h * e_q = \frac{V_q}{\frac{V_{h1} + V_{h2} + V_{h3}}{3}} \tag{17}$$

Equations (15), (16), (17) are substituted in Equations (7), (8), (9):

$$k_1 = \frac{V_{h1}}{V_{h1} + V_{h2} + V_{h3}} = \frac{V_z}{V_{h1} + V_{h2} + V_{h3}} * \frac{1}{e_{h1}} \tag{18}$$

-continued $$k_2 = \frac{V_{h2}}{V_{h1} + V_{h2} + V_{h3}} = \frac{V_z}{V_{h1} + V_{h2} + V_{h3}} * \frac{1}{e_{h2}} \quad (19)$$

$$k_3 = \frac{V_{h3}}{V_{h1} + V_{h2} + V_{h3}} = \frac{V_z}{V_{h1} + V_{h2} + V_{h3}} * \frac{1}{e_{h3}} \quad (20)$$

Assuming $\rho_1=\rho_2=\rho_3=\rho$, and adjusting the speeds of the first back roller, the second back roller and the third back roller making sure that $V_{h1}+V_{h2}+V_{h3}=V_Z$, then Equations (18), (19), (20) are changed as:

$$k_1 = \frac{V_{h1}}{V_z} = \frac{1}{e_{h1}}$$

$$k_2 = \frac{V_{h2}}{V_z} = \frac{1}{e_{h2}}$$

$$k_3 = \frac{V_{h3}}{V_z} = \frac{1}{e_{h3}}$$

The blending ratios of the three ingredients $\rho_1$, $\rho_2$, $\rho_3$ in the yarn are equal to the inverses of their respective drafting ratios.

$$e_{h1} = \frac{V_z}{V_{h1}} = \frac{1}{k_1}$$

$$e_{h2} = \frac{V_z}{V_{h2}} = \frac{1}{k_2}$$

$$e_{h3} = \frac{V_z}{V_{h3}} = \frac{1}{k_3}$$

For example, assuming:

$k_1$=0, 0.1, 0.2, 0.3, 0.4, 0.5, 0.6, 0.7, 0.8, 0.9, 1

$k_2$=0.7, 0.6, 0.5, 0.4, 0, 3, 0, 2, 0.1, 0, 0.1, 0.1, 0

$k_3$=0.3, 0.3, 0.3, 0.3, 0.3, 0.3, 0.3, 0, 3, 0.1, 0, 0

Then $e_{h1}$, $e_{h2}$ and $e_{h3}$ can be calculated respectively, as showed in Table 2.

TABLE 2

| Blend ratio and first-stage drafting ratio | | | | | | | | | | | |
|---|---|---|---|---|---|---|---|---|---|---|---|
| $k_1$ | 0 | 0.1 | 0.2 | 0.3 | 0.4 | 0.5 | 0.6 | 0.7 | 0.8 | 0.9 | 1 |
| $e_{h1}$ | X | 10 | 5 | 10/3 | 10/4 | 10/5 | 10/6 | 10/7 | 10/8 | 10/9 | 1 |
| $k_2$ | 0.7 | 0.6 | 0.5 | 0.4 | 0.3 | 0.2 | 0.1 | 0 | 0.1 | 0.1 | 0 |
| $e_{h2}$ | 10/7 | 10/6 | 10/5 | 10/4 | 10/3 | 5 | 10 | X | 10 | 10 | X |
| $k_3$ | 0.3 | 0.3 | 0.3 | 0.3 | 0.3 | 0.3 | 0.3 | 0.3 | 0.1 | 0 | 0 |
| $e_{h3}$ | 10/3 | 10/3 | 10/3 | 10/3 | 10/3 | 10/3 | 10/3 | 10/3 | 10 | X | X |

DETAILED DESCRIPTION OF THE INVENTION

Figure 1:
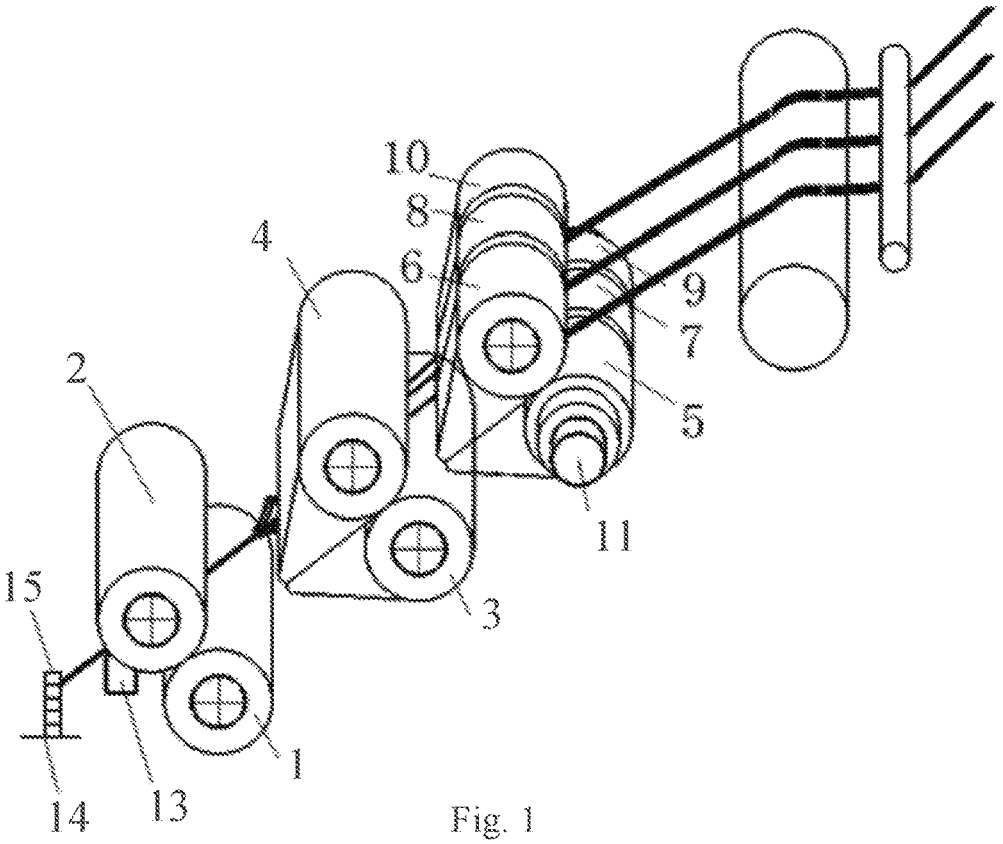
FIG. 1 is a principle schematic diagram of the two-stage drafting spinning device.

The embodiments of the invention are described as below, in combination with the accompanying drawings.

Embodiment 1

As demonstrated by FIG. 1-5, a method of dynamically configuring linear density and blending ratio of yarn by three-ingredient asynchronous/synchronous drafting is disclosed, comprising:

1) a drafting and twisting system includes a first stage drafting unit and a successive second stage drafting unit;

2) the first stage drafting unit includes a combination of back rollers 11 and a middle roller 3; The combination of back rollers has three rotational degrees of freedom and includes a first back roller 5, a second back roller 7, a third back roller 9, which are set abreast on a same back roller shaft. The second stage synchronous drafting unit includes a front roller 1 and the middle roller 3. 4 is the top roller of middle roller 3. 6, 8, 10 are the top rollers of three back rollers respectively. 2 is the top roller of front roller 1. 14 and 13 are the winding device and guider roller respectively. 15 is the yarn Y. $O_1$,$O'_1$, $O_2$,$O_2'$, $O_3$,$O_3'$ respectively refer to axis lines of back rollers, the middle roller and the front roller.

The first back roller, the second back roller, the third back roller move at the speeds $V_{h1}$, $V_{h2}$, and $V_{h3}$ respectively. The middle roller rotates at the speed $V_z$. The second stage synchronous drafting unit includes a front roller and the middle roller. The front roller rotates at the surface linear speed $V_q$.

Figure 2:
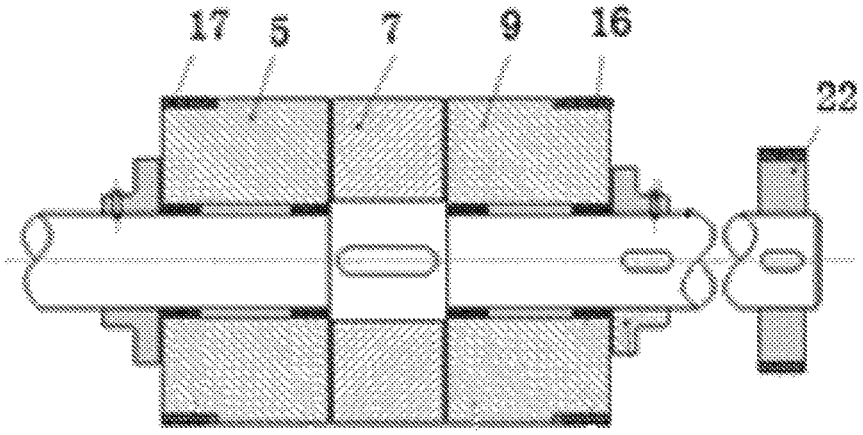
FIG. 2 is a structural schematic diagram of a combination of back rollers.
Figure 3:
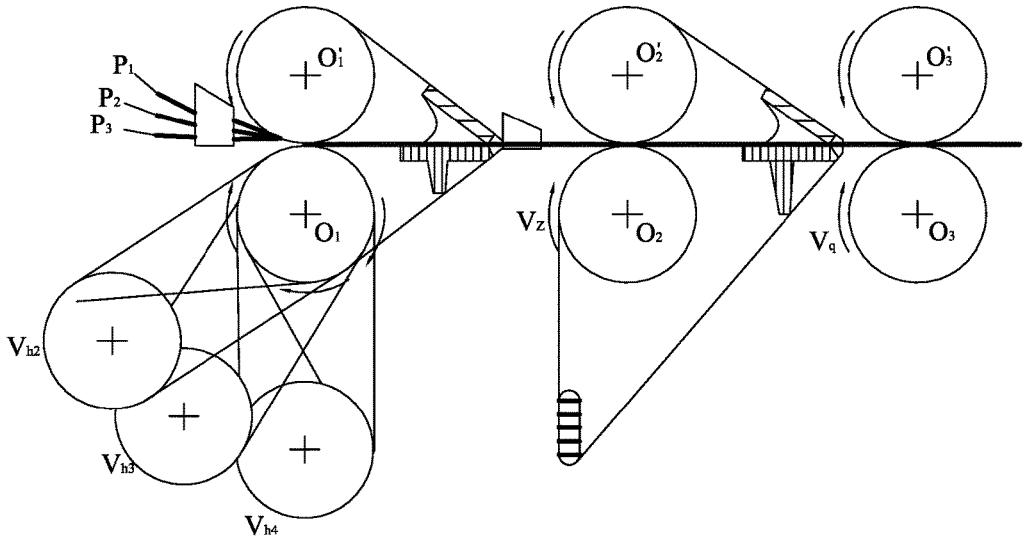
FIG. 3 is a structural side view of the two-stage drafting spinning device.

FIG. 2 shows a three-nested combination of back rollers with three rotational degrees of freedom. The three movable back rollers 5, 7, 9 are respectively driven by a core shaft and pulleys 16, 22 and 17.

Figure 4:
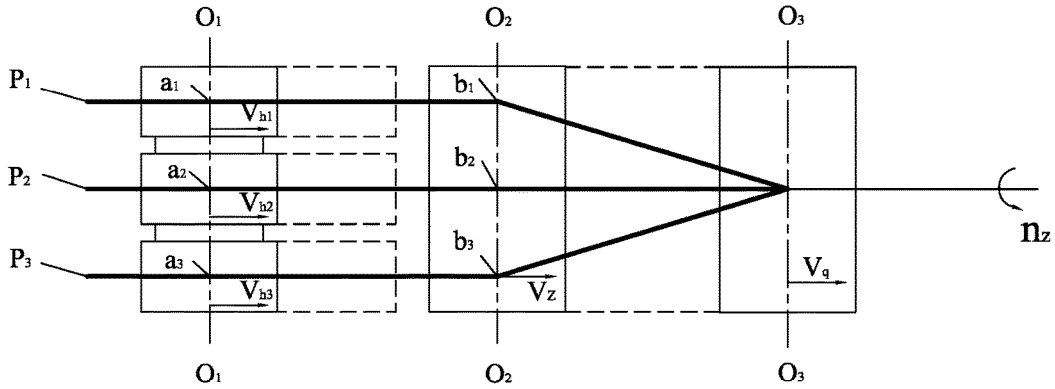
FIG. 4 is a yarn route of the two-stage drafting in an embodiment.

FIG. 4 illustrates the yarn route of the two-stage drafting. During the process of spinning, the three roving yarns are fed in parallel into the corresponding independently driven first stage drafting mechanism to be asynchronously drafted, and synchronously drafted and integrated by the second stage drafting mechanism, and then twisted to form a yarn Y. Dynamical change of blend ratio and yarn density can be controlled exactly by the first-stage asynchronous drafting. The yarn density can be controlled by the second-stage drafting. Thus the yarn can be produces with much fine mixing and low breaking ration.

Figure 5:
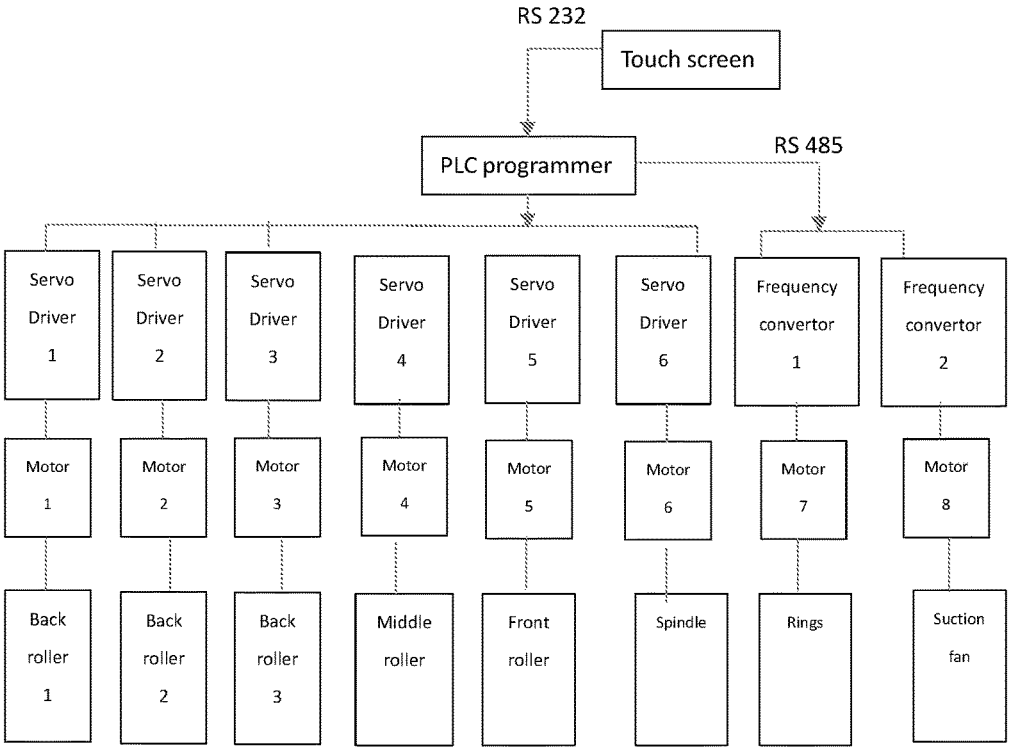
FIG. 5 is a structural schematic diagram of a control system.

As figured out by FIG. 5 the control system mainly includes a PLC programmable controller, a servo driver, a servo motor, Recommended Standard (RS) 232 serial port, RS 485 serial port, etc. PLC programmable controller controls rollers, ring rails and spindles by servo motor which is controlled by servo driver.

Assuming the linear densities of a first roving yarn ingredient, a second roving yarn ingredient, a third roving yarn ingredient drafted by the first back roller, the second back roller, the third back roller are respectively $\rho_1$, $\rho_2$, and $\rho_3$, the linear density of the yarn Y drafted and twisted by the front roller is $\rho_y$.

$$\rho_y = \frac{1}{V_q}(V_{h1} * \rho_1 + V_{h2} * \rho_2 + V_{h3} * \rho_3) \tag{1}$$

The blending ratios of the first roving yarn ingredient, the second roving yarn ingredient, and the third roving yarn ingredient are respectively $k_1$, $k_2$, and $k_3$.

$$k_1 = \frac{\rho_1''}{\rho_1'' + \rho_2'' + \rho_3''} = \frac{\rho_1'}{\rho_1' + \rho_2' + \rho_3'} = \frac{\rho_1 * V_{h1}}{\rho_1 * V_{h1} + \rho_2 * V_{h2} + \rho_3 * V_{h3}}$$

$$k_2 = \frac{\rho_2''}{\rho_1'' + \rho_2'' + \rho_3''} = \frac{\rho_2'}{\rho_1' + \rho_2' + \rho_3'} = \frac{\rho_2 * V_{h2}}{\rho_1 * V_{h1} + \rho_2 * V_{h2} + \rho_3 * V_{h3}}$$

$$k_3 = \frac{\rho_3''}{\rho_1'' + \rho_2'' + \rho_3''} = \frac{\rho_3'}{\rho_1' + \rho_2' + \rho_3'} = \frac{\rho_3 * V_{h3}}{\rho_1 * V_{h1} + \rho_2 * V_{h2} + \rho_3 * V_{h3}}$$

3) Keeping the ratio of linear speeds of the front roller and the middle roller $V_q/V_z$ constant, the speeds of the front roller and the middle roller depend on reference linear density of the yarn;

4) The linear density of yarn Y or/and blending ratio can be dynamically adjusted on line, by adjusting the rotation rates of the first back roller, the second back roller, the third back roller.

5) Further, the blending ratios of the first roving yarn ingredient, the second roving yarn ingredient, the third roving yarn ingredient are set respectively as $k_1$, $k_2$, and $k_3$. The ratios of blending ratios of the yarn Y are respectively $K_1$, and $K_2$.

$$K_1 = \frac{k_1}{k_2} = \frac{\rho_1 V_{h1}}{\rho_2 V_{h2}}$$

$$K_2 = \frac{k_1}{k_3} = \frac{\rho_1 V_{h1}}{\rho_3 V_{h3}}$$

Linear density of yarn Y is $$\rho_y = \frac{V_{h1} * \rho_1 + V_{h2} * \rho_2 + V_{h3} * \rho_3}{V_q}$$

then a surface linear speed of the back roller 1:

$$V_{h1} = \frac{\rho_y V_q}{\rho_1\left(1 + \frac{1}{K_1} + \frac{1}{K_2}\right)}$$

a surface linear speed of the back roller 2:

$$V_{h2} = \frac{\rho_y V_q}{\rho_2\left(1 + K_1 + \frac{K_1}{K_2}\right)}$$

a surface linear speed of the back roller 3:

$$V_{h3} = \frac{\rho_y V_q}{\rho_3\left(1 + K_2 + \frac{K_2}{K_1}\right)}$$

wherein $\rho_1$, $\rho_2$ and $\rho_3$ are constants, and $K_i$ and $\rho_y$ are functions changing with time t.

6) Further, let $\rho_1=\rho_2=\rho_3=\rho$, then:

(1) change the speed of any one of the first back roller, the second back roller, and the third back roller, and keep the speeds of the other two backer rollers unchanged. The yarn ingredient and the linear density thereof of the yarn Y drafted by this back roller change accordingly. The linear density $\rho'_y$ of the yarn Y is adjusted as:

$$\rho_y' = \rho_y + \Delta\rho_y = \frac{\rho}{V_q} * (V_{h1} + V_{h2} + V_{h3} + \Delta V_{h3}) \text{ or}$$

$$\rho_y' = \rho_y + \Delta\rho_y = \frac{\rho}{V_q} * (V_{h1} + V_{h2} + V_{h3} + \Delta V_{h2}) \text{ or}$$

$$\rho_y' = \rho_y + \Delta\rho_y = \frac{\rho}{V_q} * (V_{h1} + V_{h2} + V_{h3} + \Delta V_{h1})$$

wherein $\Delta\rho_y$ is a linear density change of the yarn, $\Delta V_{h1}$, $\Delta V_{h2}$ and $\Delta V_{h3}$ is a speed change of the first back roller, the second back roller, and the third back roller respectively.

(2) change the speeds of any two back rollers of the first back roller, the second back roller, and the third back roller, and keep the speeds of the other backer roller unchanged. The yarn ingredients of the yarn Y drafted by these any two back rollers and the linear densities thereof change accordingly. The linear density $\rho'_y$ of yarn Y is adjusted as:

$$\rho_y' = \rho_y + \Delta\rho_y = \frac{\rho}{V_q} * [V_{h1} + V_{h2} + V_{h3} + (\Delta V_{h1} + \Delta V_{h2})] \text{ or}$$

$$\rho_y' = \rho_y + \Delta\rho_y = \frac{\rho}{V_q} * [V_{h1} + V_{h2} + V_{h3} + (\Delta V_{h2} + \Delta V_{h3})] \text{ or}$$

$$\rho_y' = \rho_y + \Delta\rho_y = \frac{\rho}{V_q} * [V_{h1} + V_{h2} + V_{h3} + (\Delta V_{h1} + \Delta V_{h3})]$$

(3) change the speeds of three back rollers of the first back roller, the second back roller, and the third back roller simultaneously. The yarn ingredients of the yarn Y drafted by these three back rollers and the linear densities thereof change accordingly. The linear density $\rho'_y$ of the yarn Y is adjusted as:

$$\rho_y' = \rho_y + \Delta\rho_y = \frac{\rho}{V_q} * [V_{h1} + V_{h2} + V_{h3} + (\Delta V_{h1} + \Delta V_{h2} + \Delta V_{h3})]$$

7) Further, change the speeds of the first back roller, the second back roller, and the third back roller, and make the speed of any of back rollers equal to zero, while the speeds of the other two backer rollers unequal to zero. The yarn ingredient of the yarn Y drafted by the any one of back rollers is thus discontinuous, while the other two yarn ingredients are continuous. The linear density $\rho'_y$ of yarn Y is adjusted as:

$$\rho_y' = \rho_y + \Delta\rho_y =$$

-continued $$\frac{\rho}{V_q} * [(V_{h1} + V_{h1}) + (V_{h2} + \Delta V_{h2}) + (\Delta V_{h3} + \Delta V_{h3})] \ (0 \le t \le T_1)$$

$$\rho'_y = \rho_y + \Delta\rho_y = \frac{\rho}{V_q} * [(V_{h1} + V_{h1}) + (V_{h2} + \Delta V_{h2})] \ (T_1 \le t \le T_2) \text{ or}$$

$$\rho'_y = \rho_y + \Delta\rho_y = \frac{\rho}{V_q} * [(V_{h1} + V_{h1}) + (V_{h3} + \Delta V_{h3})] \ (T_1 \le t \le T_2) \text{ or}$$

$$\rho'_y = \rho_y + \Delta\rho_y = \frac{\rho}{V_q} * [(V_{h2} + V_{h2}) + (V_{h3} + \Delta V_{h3})] \ (T_1 \le t \le T_2)$$

wherein $T_1$ and $T_2$ are time points, and t is a time variable.

8) Further, change the speeds of the first back roller, the second back roller, and the third back roller, make the speeds of any two back rollers equal to zero successively, while the speeds of the other one backer rollers unequal to zero. The yarn ingredients of the yarn Y drafted by the any two back rollers are thus discontinuous, while the other yarn ingredients are continuous. The linear density $\rho'_y$ of the yarn Y is adjusted as:

(1) When the first back roller is unequal to zero $$\rho'_y = \rho_y + \Delta\rho_y = \frac{\rho}{V_q} * [(V_{h1} + V_{h1}) + (V_{h2} + \Delta V_{h2}) + (\Delta V_{h3} + \Delta V_{h3})] \ (0 \le t \le T_1)$$

$$\rho'_y = \rho_y + \Delta\rho_y = \frac{\rho}{V_q} * [(V_{h1} + V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h1} + V_{h1})] \ (T_2 \le t \le T_3) \text{ or}$$

$$\rho'_y = \rho_y + \Delta\rho_y = \frac{\rho}{V_q} * [(V_{h1} + V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h1} + V_{h1})] \ (T_2 \le t \le T_3)$$

wherein $T_3$ is time points, and $T_1 \le T_2 \le T_3$.

(2) When the second back roller is unequal to zero $$\rho'_y = \rho_y + \Delta\rho_y = \frac{\rho}{V_q} * [(V_{h1} + V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h2} + V_{h2})] \ (T_2 \le t \le T_3) \text{ or}$$

$$\rho'_y = \rho_y + \Delta\rho_y = \frac{\rho}{V_q} * [(V_{h2} + V_{h2}) + (V_{h3} + \Delta V_{h3})] \ (T_1 \le t \le T_2)$$

$$\rho'_y = \rho_y + \Delta\rho_y = \frac{\rho}{V_q} * [(V_{h2} + \Delta V_{h2})] \ (T_2 \le t \le T_3).$$

(3) When the third back roller is unequal to zero $$\rho'_y = \rho_y + \Delta\rho_y = \frac{\rho}{V_q} * [(V_{h1} + V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h3} + \Delta V_{h3})] \ (T_2 \le t \le T_3) \text{ or}$$

$$\rho'_y = \rho_y + \Delta\rho_y = \frac{\rho}{V_q} * [(V_{h2} + V_{h2}) + (V_{h3} + \Delta V_{h3})] \ (T_1 \le t | \le T_2)$$

-continued $$\rho'_y = \rho_y + \Delta\rho_y = \frac{\rho}{V_q} * [(V_{h3} + \Delta V_{h3})] \ (T_2 \le t \le T_3)$$

9) further change the speeds of the first back roller, the second back roller, and the third back roller, make the speeds of any two back rollers equal to zero simultaneously, while the speeds of the other one backer rollers unequal to zero. The yarn ingredients of the yarn Y drafted by the any two back rollers are thus discontinuous, while the other one yarn ingredients are continuous. The linear density $\rho'_y$ of the yarn Y is adjusted as:

$$\rho'_y = \rho_y + \Delta\rho_y = \frac{\rho}{V_q} * [(V_{h1} + V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1})] \ (T_1 \le t \le T_2) \text{ or}$$

$$\rho'_y = \rho_y + \Delta\rho_y = \frac{\rho}{V_q} * [(V_{h2} + \Delta V_{h2})] \ (T_1 \le t \le T_2) \text{ or}$$

$$\rho'_y = \rho_y + \Delta\rho_y = \frac{\rho}{V_q} * [(V_{h3} + \Delta V_{h3})] \ (T_1 \le t \le T_2).$$

10) Further, change the speeds of the first back roller, the second back roller, and the third back roller, and keep $V_{h1}*\rho_1+V_{h2}*\rho_2+V_{h3}*\rho_3$=constant and $\rho_1=\rho_2=\rho_3=\rho$, then the linear density of the yarn Y is thus fixed while the blending ratios of the ingredients thereof change; the blending ratios of the first yarn ingredient, the second yarn ingredient, and the third yarn ingredient are $k_1$, $k_2$, $k_3$.

$$k_1 = \frac{V_{h1} + \Delta V_{h1}}{V_{h1} + \Delta V_{h1} + V_{h2} + \Delta V_{h2} + V_{h3} + \Delta V_{h3}}$$

$$k_2 = \frac{V_{h2} + \Delta V_{h2}}{V_{h1} + \Delta V_{h1} + V_{h2} + \Delta V_{h2} + V_{h3} + \Delta V_{h3}}$$

$$k_3 = \frac{V_{h3} + \Delta V_{h3}}{V_{h1} + \Delta V_{h1} + V_{h2} + \Delta V_{h2} + V_{h3} + \Delta V_{h3}}$$

Embodiment 2

The method of this embodiment is substantially the same as Embodiment 1, and the differences are:

1) according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of the first back roller, the second back roller, the third back roller are $V_{h1i}$, $V_{h2i}$, $V_{h3i}$, wherein $i \in (1, 2, \ldots, n)$ The first roving yarn ingredient, the second roving yarn ingredient, the third roving yarn ingredient ingredient are two-stage drafted and twisted to form segment i of the yarn Y, and the blending ratios $k_{1i}$, $k_{2i}$ and $k_{3i}$ thereof are expressed as below:

$$k_{11} = \frac{\rho_1 * \Delta V_{h11}}{\rho_1 * V_{h11} + \rho_2 * V_{h21} + \rho_3 * V_{h31}} \quad (2)$$

-continued $$k_{21} = \frac{\rho_2 * \Delta V_{h21}}{\rho_1 * V_{h11} + \rho_2 * V_{h21} + \rho_3 * V_{h31}} \quad (3)$$

$$k_{31} = \frac{\rho_3 * \Delta V_{h31}}{\rho_1 * V_{h11} + \rho_2 * V_{h21} + \rho_3 * V_{h31}} \quad (4)$$

the linear density of segment i of yard Y is:

$$\rho_{yi} = \frac{V_z}{V_q} * \left(\frac{V_{h11}}{V_x} * \rho_1 + \frac{V_{h21}}{V_\square}\rho_2 + \frac{V_\square}{V_x}\rho_3\right) = \frac{1}{e_q} * \left(\frac{V_{h11}}{V_x} * \rho_1 + \frac{V_{h21}}{V_x}\rho_2 + \frac{V_{h31}}{V_x}\rho_3\right) \quad (5)$$

wherein $$e_q = \frac{V_q}{V_z}$$

is the two-stage arming ratio;

2) Take the segment with the lowest density as a reference segment, whose reference linear density is $\rho_0$. The reference linear speeds of the first back roller, the second back roller, the third back roller for this segment are respectively $V_{h10}$, $V_{h20}$, $V_{h30}$; and the reference blending ratios of the first roving yarn ingredient, the second roving yarn ingredient, the third roving yarn ingredient for this segment are respectively $k_{10}$, $k_{20}$, $k_{30}$, Keep the linear speed of the middle roller constant, and $$V_z = V_{h10} + V_{h20} + V_{h30} \quad (6);$$

also keep two-stage drafting ratio $$e_q = \frac{V_q}{V_z}$$

constant;

wherein the reference linear speeds of the first back roller, the second back roller, the third back roller for this segment are respectively $V_{h10}$, $V_{h20}$, $V_{h30}$, which can be predetermined according to the material, reference linear density $\rho_0$ and reference blending ratios $k_{10}$, $k_{20}$, $k_{30}$ of the first roving yarn ingredient, the second roving yarn ingredient, the third roving yarn ingredient.

3) When the segment i of the yarn Y is drafted and blended, on the premise of known set linear density $\rho_{yi}$ and blending ratios $k_{1i}$, $k_{2i}$, $k_{3i}$, the linear speeds $V_{h1i}$, $V_{h2i}$, $V_{h3i}$, of the first back roller, the second back roller, the third back roller are calculated according to Equations (2)-(6);

4) Based on the reference linear speeds $V_{h10}$, $V_{h20}$, $V_{h30}$ for the reference segment, increase or decrease the rotation rates of the first back roller, the second back roller, the third back roller to dynamically adjust the linear density or/and blending ratio for the segment i of the yarn Y.

5) Further, let $\rho_1 = \rho_2 = \rho_3 = \rho$ then Equation (5) can be simplified as $$\rho_{yi} = \frac{\rho}{e_q} * \frac{V_{h11} + V_{h21} + V_{h31}}{V_1}; \quad (7)$$

According to Equations (2)-(4) and (6)-(7), the linear speeds $V_{h1i}$, $V_{h2i}$, $V_{h3i}$ of the first back roller, the second back roller, the third back roller are calculated; based on the reference linear speeds $V_{h10}$, $V_{h20}$, $V_{h30}$, the rotation rates of the first back roller, the second back roller, the third back roller are increased or decreased to reach the preset linear density and blending ratio for the segment i of yarn Y.

6) Further, at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller, the third back roller have corresponding increments on the basis of the reference linear speed, i.e., when $(V_{h10}+V_{h20}+V_{h30}) \rightarrow (V_{h10}+\Delta V_{h1i}+V_{h20}+\Delta V_{h2i}+V_{h30}+\Delta V_{h3i})$, the linear density increment of yarn Y is:

$$\Delta\rho_{yi} = \frac{\rho}{e_q \times V_z} * (\Delta V_{h11} + \Delta V_{h21} + \Delta V_{h31}).$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i} + \Delta V_{h3i}}{V_z} * \frac{\rho}{e_q}. \quad (8)$$

Let $\Delta V_1 = \Delta V_{h1i} + \Delta V_{h2i} + \Delta V_{h3i}$, then Equation (8) is simplified as:

$$\rho_{yi} = \rho_{y0} + \frac{\Delta V_1}{V_z} * \frac{\rho}{e_q}. \quad (9)$$

The linear density of yarn Y can be adjusted by controlling the sum of the linear speed increments $\Delta V_i$ of the first back roller, the second back roller, the third back roller.

7) Further, let $\rho_1 = \rho_2 = \rho_3 = \rho$ at the moment of switching the segment i−1 to the segment i of the yarn Y, the blending ratios of the yarn Yin Equations (2)-(3) can be simplified as:

$$k_{1i} = \frac{V_{h10} + \Delta V_{h1i}}{V_z + \Delta V_i} \quad (10)$$

$$k_{2i} = \frac{V_{h20} + \Delta V_{h2i}}{V_z + \Delta V_i} \quad (11)$$

$$k_{3i} = \frac{V_{h30} + \Delta V_{h3i}}{V_z + \Delta V_i} \quad (12)$$

The blending ratios of the yarn Y can be adjusted by controlling the linear speed increments of the first back roller, the second back roller, the third back roller;

wherein $$\Delta V_{h1i} = k_{1i} * (V_Z + \Delta V_i) - V_{h10}$$

$$\Delta V_{h2i} = k_{2i} * (V_Z + \Delta V_i) - V_{h20}$$

$$\Delta V_{h3i} = k_{3i} * (V_Z + \Delta V_i) - V_{h30}.$$

8) Further, let $V_{h1i} * \rho_1 + V_{h2i} * \rho_2 + V_{h3i} * \rho_3 = H$ and H is a constant, then $\Delta V_i$ is constantly equal to zero, and thus the linear density is unchanged when the blending ratios of the yarn Y are adjusted.

9) Further, let any one to two of $\Delta V_{h1i}$, $\Delta V_{h2i}$, $\Delta V_{h3i}$ be equal to zero, while the remaining ones are not zero, then the one to two roving yarn ingredients can be changed while the other roving yarn ingredients are unchanged. The adjusted blending ratio are:

$$k_{ki} = \frac{V_{hk0} + \Delta V_{hki}}{V_z + \Delta V_i}$$

$$k_{ji} = \frac{V_{hj0}}{V_z + \Delta V_i}$$

wherein k, j∈(1, 2, 3), and k≠j.

10) Further, let none of $\Delta V_{h1i}$, $\Delta V_{h2i}$, $\Delta V_{h3i}$ be equal to zero, then the proportion of the three roving yarn ingredients in the yarn Y may be changed.

11) Further, let any one to two of $\Delta V_{h1i}$, $\Delta V_{h2i}$, $\Delta V_{h3i}$ be equal to zero, while the remaining ones are not zero, then the one to two roving yarn ingredients of the segment i of the yarn Y may be discontinuous.

Embodiment 3

The method of dynamically configuring linear density and blending ratio of a yarn by three-ingredient asynchronous drafting disclosed in this embodiment is substantially the same as Embodiment 2, and the differences are:

Set the initial linear speeds of the first back roller, a second back roller, a third back roller as $V_{h10}$, $V_{h20}$, $V_{h30}$; the initial linear speed of the middle roller $V_{z0}=V_{h10}+V_{h20}+V_{h30}$ In addition, set $V_{Zi}=V_{h1(i-1)}+V_{h2(i-1)}+V_{h3(i-1)}$, and let the two-stage drafting ratio $$e_{qi} = \frac{v_{qi}}{v_{zi}}$$

constantly be equal to the set value $e_q$;

When drafting and blending the segment i of the yarn Y, take the linear density and the blending ratio of the segment i−1 as a reference linear density and a reference blending ratio of segment i. On the premise of the known set linear density $\rho_{yi}$ and blending ratios $k_{1i}$, $k_{2i}$, $k_{3i}$, the linear speeds $V_{h1i}$, $V_{h2i}$, $V_{h3i}$ of a first back roller, a second back roller, a third back roller are calculated.

On the basis of the segment i−1, the rotation rates of the first back roller the second back roller and the third back roller are adjusted to dynamically regulate the linear density or/and blending ratio of segment i of the yarn Y on line.

In the method, $V_{Zi}=V_{h1(i-1)}+V_{h2(i-1)}+V_{h3(i-1)}$ and the two-stage drafting ratio is constant, and thus the speeds of the middle roller and the front roller are continually adjusted with the speeds of the back rollers, to avoid a substantial change of the drafting ratio of the yarn resulted from untimely adjusted speeds of the middle roller and the front roller as opposed to a relatively large speed adjustment of the combination of the back rollers, and effectively prevent yarn breakage.

In addition, the operating speed of each roller is recorded in real time by a computer or other intellectual control unit, and thus the speeds of the middle roller and the front roller in the next step can be automatically calculated if the current speeds of the back rollers are known. The speed increments/decrements of the combination of the back rollers are calculated quickly with the above equations and models, to adjust the set blending ratio and linear density more easily and accurately.

TABLE 3

Parameter comparison between asynchronous drafting and synchronous drafting (taking 18.45tex cotton yarn as an example)

| | Synchronous drafting for single ingredient spinning | | Synchronous drafting for double ingredients spinning | | Synchronous drafting for double ingredients spinning | | Asynchronous drafting for three ingredients spinning | | |
|---|---|---|---|---|---|---|---|---|---|
| | | | Ingredient 1 | Ingredient 2 | Ingredient 1 | Ingredient 2 | Ingredient 1 | Ingredient 2 | Ingredient 3 |
| Roving yarn weight (g/5 in) | 5.0 | | 5.0 | 5.0 | 5.0 | 5.0 | 5.0 | 5.0 | 5.0 |
| Back area drafting ratio | 1.1-1.3 | 1.1-1.3 | 1.1-1.3 | 1.1-1.3 | 1.1-1.3 | 1.1-1.3 | 3°(k1 + k2 + 3)/k1 Changes with the blending ratio | 3°(k1 + k2 + k3)/k2 Changes with the blending ratio | 3°(k1 + k2 + k3)/k3 Changes with the blending ratio |
| Front area drafting ratio | 24.6-20.8 | 32.7 | 49.2-41.6 | 49.2-41.6 | 45.4 | 45.4 | 81.6 | 81.6 | 81.6 |
| Back roller speed | unchanged | changed | unchanged | | changed | | Asynchronous change | Asynchronous change | Asynchronous change |
| Middle roller speed | unchanged | unchanged | unchanged | | unchanged | | | unchanged | |
| Front roller speed | unchanged | unchanged | unchanged | | unchanged | | | unchanged | |
| Average spinning number (tex) | 18.45 | 18.45 | 18.45 | | 18.45 | | | 18.45 | |
| Linear speed variable | invariable | Limitedly variable | invariable | | Limitedly variable | | | Variable, adjustable | |
| Blending ratio variable | invariable | invariable | invariable | | Limitedly variable | | | Variable, adjustable | |

TABLE 3-continued

Parameter comparison between asynchronous drafting and synchronous drafting (taking 18.45tex cotton yarn as an example)

| | Synchronous drafting | | Synchronous drafting for double ingredients spinning | | Synchronous drafting for double ingredients spinning | | Asynchronous drafting for three ingredients spinning | | | |
|---|---|---|---|---|---|---|---|---|---|---|
| | for single ingredient spinning | | Ingredient 1 | Ingredient 2 | Ingredient 1 | Ingredient 2 | Ingredient 1 | Ingredient 2 | Ingredient 3 | |
| Linear speed and blending ratio both variable | invariable | invariable | invariable | | Limitedly variable | | Variable, adjustable | | | |
| Spinning effect | Even yarn | Slub yarn | Even yarn | | Limited segmented color Limited slub yarn | | Even yarn Any blending ratio Color-blended yarn | Even yarn Any blending ratio Segment-color blended yarn | Even yarn Any blending ratio Segment-color blended yarn | Even yarn Any blending ratio slub yarn |

Several preferable embodiments are described, in combination with the accompanying drawings. However, the invention is not intended to be limited herein. Any improvements and/or modifications by the skilled in the art, without departing from the spirit of the invention, would fall within protection scope of the invention.

What is claimed is:

1. A method of dynamically configuring a linear density and a blending ratio of a yarn by three-ingredient asynchronous/synchronous drafting, comprising:

providing an actuating mechanism, wherein the actuating mechanism includes a three-ingredient asynchronous/synchronous two-stage drafting mechanism, a twisting mechanism and a winding mechanism; wherein the three-ingredient asynchronous/synchronous two-stage drafting mechanism includes a first stage asynchronous drafting unit and a successive second stage synchronous drafting unit;

providing a combination of a plurality of back roller and a middle roller included by the first stage asynchronous drafting unit; wherein the combination of back rollers has three rotational degrees of freedom and includes a first back roller, a second back roller, a third back roller, which are set abreast on a same back roller shaft; the first back roller, the second back roller, the third back roller move at the speeds $V_{h1}$, $V_{h2}$, and $V_{h3}$ respectively; the middle roller rotates at the speed $V_z$; the second stage synchronous drafting unit includes a front roller and the middle roller; the front roller rotates at the surface linear speed $V_q$;

assuming the linear densities of a first roving yarn ingredient, a second roving yarn ingredient, a third roving yarn ingredient drafted by the first back roller, the second back roller, the third back roller are respectively $\rho_1$, $\rho_2$, and $\rho_3$, the linear density of the yarn Y drafted and twisted by the front roller is $\rho_y$;

$$\rho_y = \frac{1}{V_q}(V_{h1} * \rho_1 + V_{h2} * \rho_2 + V_{h3} * \rho_3) \tag{1}$$

the blending ratios of the first roving yarn ingredient, the second roving yarn ingredient, and the third roving yarn ingredient are respectively $k_1$, $k_2$, and $k_3$;

$$k_1 = \frac{\rho_1''}{\rho_1'' + \rho_2'' + \rho_3''} = \frac{\rho_1'}{\rho_1' + \rho_2' + \rho_3'} = \frac{\rho_1 * V_{h1}}{\rho_1 * V_{h1} + \rho_2 * V_{h2} + \rho_3 * V_{h3}}$$

$$k_2 = \frac{\rho_2''}{\rho_1'' + \rho_2'' + \rho_3''} = \frac{\rho_2'}{\rho_1' + \rho_2' + \rho_3'} = \frac{\rho_2 * V_{h2}}{\rho_1 * V_{h1} + \rho_2 * V_{h2} + \rho_3 * V_{h3}}$$

$$k_3 = \frac{\rho_3''}{\rho_1'' + \rho_2'' + \rho_3''} = \frac{\rho_3'}{\rho_1' + \rho_2' + \rho_3'} = \frac{\rho_3 * V_{h3}}{\rho_1 * V_{h1} + \rho_2 * V_{h2} + \rho_3 * V_{h3}}$$

keeping the ratio of linear speeds of the front roller and the middle roller $V_q/V_z$ constant, the speeds of the front roller and the middle roller depend on reference linear density of the yarn;

adjusting the rotation rates of the first back roller, the second back roller, the third back roller, so as to dynamically adjust the linear density and a blending ratio K of a yarn Y online.

2. The method of claim 1, wherein according to the changes of the blending ratio K of the yarn Y with a time t, and the changes of the linear density $\rho_y$ of the yarn Y with the time t, the changes of surface linear speeds of the first back roller, the second back roller, the third back roller are derived; blending ratios of the first roving yarn ingredient, the second roving yarn ingredient, the third roving yarn ingredient are set respectively as $k_1$, $k_2$, and $k_3$; a plurality of blending ratios of the yarn Y are respectively $K_1$, and $K_2$:

$$K_1 = \frac{k_1}{k_2} = \frac{\rho_1 V_{h1}}{\rho_2 V_{h2}'}$$

$$K_2 = \frac{k_1}{k_3} = \frac{\rho_1 V_{h1}}{\rho_3 V_{h3}}$$

a linear density of yarn Y is $$\rho_y = \frac{V_{h1} * \rho_1 + V_{h2} * \rho_2 + V_{h3} * \rho_3}{V_q}$$

then a surface linear speed of the first back roller:

$$V_{h1} = \frac{\rho_y V_q}{\rho_1\left(1 + \frac{1}{K_1} + \frac{1}{K_2}\right)}$$

a surface linear speed of the second back roller:

$$V_{h2} = \frac{\rho_y V_q}{\rho_2\left(1 + K_1 + \frac{K_1}{K_2}\right)}$$

a surface linear speed of the third back roller:

$$V_{h3} = \frac{\rho_y V_q}{\rho_3\left(1 + K_2 + \frac{K_2}{K_1}\right)}$$

wherein $\rho_1$, $\rho_2$, and $\rho_3$ are constants, and $K_i$ and $\rho_y$ are functions changing with the time t.

3. The method of claim 1, wherein if $\rho_1=\rho_2=\rho_3=\rho$, then:

1) changing the speed of any one of the first back roller, the second back roller, and the third back roller, and keeping the speeds of the other two back rollers unchanged; the yarn ingredient and the linear density thereof of the yarn Y drafted by this back roller change accordingly; the linear density $\rho'_y$ of the yarn Y is adjusted as:

$$\rho'_y = \rho_y + \Delta\rho_y = \frac{\rho}{V_q} * (V_{h1} + V_{h2} + V_{h3} + \Delta V_{h3}) \text{ or}$$

$$\rho'_y = \rho_y + \Delta\rho_y = \frac{\rho}{V_q} * (V_{h1} + V_{h2} + V_{h3} + \Delta V_{h2}) \text{ or}$$

$$\rho'_y = \rho_y + \Delta\rho_y = \frac{\rho}{V_q} * (V_{h1} + V_{h2} + V_{h3} + \Delta V_{h1})$$

wherein $\Delta\rho_y$ is a linear density change of the yarn, $\Delta V_{h1}$, $\Delta V_{h2}$ and $\Delta V_{h3}$ is a speed change of the first back roller, the second back roller, and the third back roller respectively;

2) changing the speeds of any two back rollers of the first back roller, the second back roller, and the third back roller, and keeping the speed of the other back roller unchanged; the yarn ingredients of the yarn Y drafted by these any two back rollers and the linear densities thereof change accordingly; the linear density $\rho'_y$ of yarn Y is adjusted as:

$$\rho'_y = \rho_y + \Delta\rho_y = \frac{\rho}{V_q} * [V_{h1} + V_{h2} + V_{h3} + (\Delta V_{h1} + \Delta V_{h2})] \text{ or}$$

$$\rho'_y = \rho_y + \Delta\rho_y = \frac{\rho}{V_q} * [V_{h1} + V_{h2} + V_{h3} + (\Delta V_{h2} + \Delta V_{h3})] \text{ or}$$

$$\rho'_y = \rho_y + \Delta\rho_y = \frac{\rho}{V_q} * [V_{h1} + V_{h2} + V_{h3} + (\Delta V_{h1} + \Delta V_{h3})]$$

3) changing the speeds of three back rollers of the first back roller, the second back roller, and the third back roller simultaneously; the yarn ingredients of the yarn Y drafted by these any three back rollers and the linear densities thereof change accordingly; the linear density $\rho'_y$ of the yarn Y is adjusted as:

$$\rho'_y = \rho_y + \Delta\rho_y = \frac{\rho}{V_q} * [V_{h1} + V_{h2} + V_{h3} + (\Delta V_{h1} + \Delta V_{h2} + \Delta V_{h3})].$$

4. The method of claim 3, wherein changing the speeds of the first back roller, the second back roller, and the third back roller, and making the speed of any of back rollers equal to zero, while the speeds of the other two back rollers unequal to zero; the yarn ingredient of the yarn Y drafted by the any one of back rollers is thus discontinuous, while the other two yarn ingredients are continuous; the linear density $\rho'_y$ of yarn Y is adjusted as:

$$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2) \text{ or}$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2) \text{ or}$$

$$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

wherein $T_1$ and $T_2$ are time points, and t is a time variable.

5. The method of claim 3, wherein changing the speeds of the first back roller, the second back roller, and the third back roller, making the speeds of any two back rollers equal to zero successively, while the speeds of the other one back rollers unequal to zero; the yarn ingredients of the yarn Y drafted by the any two back rollers are thus discontinuous, while the other yarn ingredients are continuous; the linear density $\rho'_y$ of the yarn Y is adjusted as:

when the first back roller is unequal to zero $$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h1} + \Delta V_{h1})] \ (T_2 \le t \le T_3) \text{ or}$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h1} + \Delta V_{h1})] \ (T_2 \le t \le T_3)$$

wherein $T_3$ is time points, and $T_1 \le T_2 \le T_3$;

when the second back roller is unequal to zero $$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h2} + \Delta V_{h2})] \ (T_1 \le t \le T_2)$$

$$\rho'_y = \rho_y + \Delta\rho_y = \frac{\rho}{V_q} * [(V_{h2} + \Delta V_{h2})] \ (T_2 \le t \le T_3) \text{ or}$$

-continued $$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

$$\rho'_y = \rho_y + \Delta\rho_y = \frac{\rho}{V_q} * [(V_{h2} + \Delta V_{h2})] \ (T_2 \le t \le T_3)$$

when the third back roller is unequal to zero $$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1}) + (V_{h3} + \Delta V_{h3})] \ (T_1 \le t \le T_2)$$

$$\rho'_y = \rho_y + \Delta\rho_y = \frac{\rho}{V_q} * [(V_{h3} + \Delta V_{h3})] \ (T_2 \le t \le T_3) \text{ or}$$

$$\rho'_y = \rho_y + \Delta\rho_y = \frac{\rho}{V_q} * [(V_{h2} + \Delta V_{h2}) + (V_{h3} + \Delta V_{h3})] \ (T_1 \le t \le T_2)$$

$$\rho'_y = \rho_y + \Delta\rho_y = \frac{\rho}{V_q} * [(V_{h3} + \Delta V_{h3})] \ (T_2 \le t \le T_3).$$

6. The method of claim 3, wherein further changing the speeds of the first back roller, the second back roller, and the third back roller, making the speeds of any two back rollers equal to zero simultaneously, while the speeds of the other one back rollers unequal to zero; the yarn ingredients of the yarn Y drafted by the any two back rollers are thus discontinuous, while the other one yarn ingredients are continuous; the linear density $\rho'_y$ of the yarn Y is adjusted as:

$$\rho'_y = \rho_y + \Delta\rho_y = \frac{\rho}{V_q} * [(V_{h1} + \Delta V_{h1}) + (V_{h2} + \Delta V_{h2}) + (V_{h3} + \Delta V_{h3})] \ (0 \le t \le T_1)$$

$$\rho'_y = \rho_y + \Delta\rho_y = \frac{\rho}{V_q} * [(V_{h1} + \Delta V_{h1})] \ (T_1 \le t \le T_2) \text{ or}$$

$$\rho'_y = \rho_y + \Delta\rho_y = \frac{\rho}{V_q} * [(V_{h2} + \Delta V_{h2})] \ (T_1 \le t \le T_2) \text{ or}$$

$$\rho'_y = \rho_y + \Delta\rho_y = \frac{\rho}{V_q} * [(V_{h3} + \Delta V_{h3})] \ (T_1 \le t \le T_2).$$

7. The method of claim 3, wherein changing the speeds of the first back roller, the second back roller, and the third back roller, and keeping $V_{h1}*\rho_1+V_{h2}*\rho_2+V_{h3}*\rho_3$=constant and $\rho_1=\rho_2=\rho_3=\rho$, then the linear density of the yarn Y is thus fixed while the blending ratios of the ingredients thereof change; the blending ratios of the first yarn ingredient, the second yarn ingredient, and the third yarn ingredient are $k_1$, $k_2$, $k_3$:

$$k_1 = \frac{V_{h1} + \Delta V_{h1}}{V_{h1} + \Delta V_{h1} + V_{h2} + \Delta V_{h2} + V_{h3} + \Delta V_{h3}}$$

$$k_2 = \frac{V_{h2} + \Delta V_{h2}}{V_{h1} + \Delta V_{h1} + V_{h2} + \Delta V_{h2} + V_{h3} + \Delta V_{h3}}$$

$$k_3 = \frac{V_{h3} + \Delta V_{h3}}{V_{h1} + \Delta V_{h1} + V_{h2} + \Delta V_{h2} + V_{h3} + \Delta V_{h3}}.$$

8. The method of claim 1, wherein further, according to the set blending ratio and/or linear density, divide the yarn Y into n segments; the linear density and blending ratio of each segment of the yarn Y are the same, while the linear densities and blending ratios of the adjacent segments are different; when drafting the segment i of the yarn Y, the linear speeds of the first back roller, the second back roller, the third back roller are $V_{h1i}$, $V_{h2i}$, $V_{h3i}$, wherein $i \in (1, 2, \ldots, n)$;

the first roving yarn ingredient, the second roving yarn ingredient, the third roving yarn ingredient are two-stage drafted and twisted to form segment i of the yarn Y, and the blending ratios $k_{1i}$, $k_{2i}$ and $k_{3i}$ thereof are expressed as below:

$$k_{1i} = \frac{\rho_1 * V_{h1i}}{\rho_1 * V_{h1i} + \rho_2 * V_{h2i} + \rho_3 * V_{h3i}} \quad (2)$$

$$k_{2i} = \frac{\rho_2 * V_{h2i}}{\rho_1 * V_{h1i} + \rho_2 * V_{h2i} + \rho_3 * V_{h3i}} \quad (3)$$

$$k_{3i} = \frac{\rho_3 * V_{h3i}}{\rho_1 * V_{h1i} + \rho_2 * V_{h2i} + \rho_3 * V_{h3i}} \quad (4)$$

the linear density of segment i of yarn Y is:

$$\rho_{yi} = \frac{V_z}{V_q} * \left(\frac{V_{h1i}}{V_z} * \rho_1 + \frac{V_{h2i}}{V_z}\rho_2 + \frac{V_{h3i}}{V_z}\rho_3\right) = \frac{1}{e_q} * \left(\frac{V_{h1i}}{V_z} * \rho_1 + \frac{V_{h2i}}{V_z}\rho_2 + \frac{V_{h3i}}{V_z}\rho_3\right) \quad (5)$$

wherein $$e_q = \frac{v_q}{v_z}$$

is the two-stage drafting ratio;

(1) take the segment with the lowest density as a reference segment, whose reference linear density is $\rho_0$; the reference linear speeds of the first back roller, the second back roller, the third back roller for this segment are respectively $V_{h10}$, $V_{h20}$, $V_{h30}$; and the reference blending ratios of the first roving yarn ingredient, the second roving yarn ingredient, the third roving yarn ingredient for this segment are respectively $k_{10}$, $k_{20}$, $k_{30}$;

keep the linear speed of the middle roller constant, and $$V_z = V_{h10} + V_{h20} + V_{h30} \quad (6);$$

(2) also keep two-stage drafting ratio $$e_q = \frac{v_q}{v_z}$$

constant; wherein the reference linear speeds of the first back roller, the second back roller, the third back roller for this segment are respectively $V_{h10}$, $V_{h20}$, $V_{h30}$, which are predetermined according to the material, reference linear density $\rho_0$ and reference blending ratios $k_{10}$, $k_{20}$, $k_{30}$ of the first roving yarn ingredient, the second roving yarn ingredient, the third roving yarn ingredient;

(3) when the segment i of the yarn Y is drafted and blended, on the premise of known set linear density $\rho_{yi}$ and blending ratios $k_{1i}$, $k_{2i}$, $k_{3i}$, the linear speeds $V_{h1i}$, $V_{h2i}$, $V_{h3i}$, of the first back roller, the second back roller, the third back roller are calculated according to equations (2)-(6);

(4) based on the reference linear speeds $V_{h10}$, $V_{h20}$, $V_{h30}$ for the reference segment, increase or decrease the rotation rates of the first back roller, the second back roller, the third back roller to dynamically adjust the linear density or/and blending ratio for the segment i of the yarn Y.

9. The method of claim 8, wherein let $\rho_1=\rho_2=\rho_3=\rho$ the equation (5) is simplified as $$\rho_{yi} = \frac{\rho}{e_q} * \frac{V_{h1i} + V_{h2i} + V_{h3i}}{V_z}; \tag{7}$$

according to equations (2)-(4) and (6)-(7), the linear speeds $V_{h1i}$, $V_{h2i}$, $V_{h3i}$ of the first back roller, the second back roller, the third back roller are calculated; based on the reference linear speeds $V_{h10}$, $V_{h20}$, $V_{h30}$, the rotation rates of the first back roller, the second back roller, the third back roller are increased or decreased to reach the preset linear density and blending ratio for the segment i of yarn Y.

10. The method of claim 9, wherein at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller, the third back roller have corresponding increments on the basis of the reference linear speed, i.e., when $(V_{h10}+V_{h20}+V_{h30})\rightarrow(V_{h10}+\Delta V_{h1i}+V_{h20}+\Delta V_{h2i}+V_{h30}\ \ \Delta V_{h3i})$ the linear density increment of yarn Y is:

$$\Delta\rho_{yi} = \frac{\rho}{e_q + V_z} * (\Delta V_{h1i} + \Delta V_{h2i} + \Delta V_{h3i});$$

then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i} + \Delta V_{h3i}}{V_z} * \frac{\rho}{e_q}; \tag{8}$$

let $\Delta V_1=\Delta V_{h1i}+\Delta V_{h2i}+\Delta V_{h3i}$; then equation (8) is simplified as:

$$\rho_{yi} = \rho_{y0} + \frac{\Delta V_1}{V_z} * \frac{\rho}{e_q}; \tag{9}$$

the linear density of yarn Y is adjusted by controlling the sum of the linear speed increments $\Delta V_i$ of the first back roller, the second back roller, the third back roller.

11. The method of claim 10, wherein let $\rho_1=\rho_2=\rho_3=\rho$ at the moment of switching the segment i−1 to the segment i of the yarn Y, the blending ratios of the yarn Y in equations (2)-(4) are simplified as:

$$k_{1i} = \frac{V_{h10} + \Delta V_{h1i}}{V_z + \Delta V_i} \tag{10}$$

-continued $$k_{2i} = \frac{V_{h20} + \Delta V_{h2i}}{V_z + \Delta V_i} \tag{11}$$

$$k_{3i} = \frac{V_{h30} + \Delta V_{h3i}}{V_z + \Delta V_i}; \tag{12}$$

the blending ratios of the yarn Y are adjusted by controlling the linear speed increments of the first back roller, the second back roller, the third back roller;

wherein $$\Delta V_{h1i}=k_{1i}*(V_Z+\Delta V_i)-V_{h10}$$

$$\Delta V_{h2i}=k_{2i}*(V_Z+\Delta V_i)-V_{h20}$$

$$\Delta V_{h3i}=k_{3i}*(V_Z+\Delta V_i)-V_{h30}.$$

12. The method of claim 11, wherein let $V_{h1i}*\rho_1+V_{h2i}*\rho_2+V_{h3i}*\rho_3=H$ and H is a constant, then $\Delta V_i$ is constantly equal to zero, and thus the linear density is unchanged when the blending ratios of the yarn Y are adjusted.

13. The method of claim 11, wherein let any one to two of $\Delta V_{h1i}$, $\Delta V_{h2i}$, $\Delta V_{h3i}$ be equal to zero, while the remaining ones are not zero, then the one to two roving yarn ingredients are changed while the other roving yarn ingredients are unchanged; the adjusted blending ratios are:

$$k_{ki} = \frac{V_{hk0} + \Delta V_{hki}}{V_z + \Delta V_i}$$

$$k_{ji} = \frac{V_{hj0}}{V_z + \Delta V_i}$$

wherein k, j∈(1, 2, 3) and k≠j;

let none of $\Delta V_{h1i}$, $\Delta V_{h2i}$, $\Delta V_{h3i}$ be equal to zero, then the proportion of the three roving yarn ingredients in the yarn Y is changed.

14. The method of claim 11, wherein let any one to two of $\Delta V_{h1i}$, $\Delta V_{h2i}$, $\Delta V_{h3i}$ be equal to zero, while the remaining ones are not zero, then the one to two roving yarn ingredients of the segment i of the yarn Y are discontinuous.

15. A device for implementing a method of dynamically configuring a linear density and a blend ratio of a yarn by three-ingredient asynchronous/synchronous drafting, comprising:

a control system, and an actuating mechanism, wherein the actuating mechanism includes a three-ingredient separate/integrated asynchronous/synchronous two-stage drafting mechanism, a twisting mechanism and a winding mechanism; the two-stage drafting mechanism includes a first stage drafting unit and a second stage drafting unit;

the first stage drafting unit includes a combination of back rollers and a middle roller; the combination of back rollers has three rotational degrees of freedom and includes a first back roller, a second back roller, a third back roller, which are set abreast on a same back roller shaft; the second stage drafting unit includes a front roller and the middle roller.

* * * * *